United States Patent [19]

Ban et al.

[11] 4,274,836

[45] Jun. 23, 1981

[54] METHOD FOR IMPROVING BED FIRING CHARACTERISTICS AND INHIBITING COALESCENCE OF COAL PELLETS

[75] Inventors: Thomas E. Ban, South Euclid; William H. Marlowe, Euclid, both of Ohio

[73] Assignee: Dravo Corporation, Pa.

[21] Appl. No.: 31,992

[22] Filed: Apr. 20, 1979

[51] Int. Cl.[3] ..... C10L 5/32

[52] U.S. Cl. ..... 44/6; 44/10 C; 201/9

[58] Field of Search ..... 44/10 R, 6, 16 C, 16 B, 44/17, 26, 1 F, 10 K; 201/9

[56] References Cited

U.S. PATENT DOCUMENTS

| | | | |
|---|---|---|---|
| 150,393 | 5/1874 | Broad | 44/26 |
| 394,486 | 12/1888 | Haas | 44/26 |
| 486,100 | 11/1892 | Fronheiser et al. | 44/26 |
| 1,860,743 | 5/1932 | Komarek | 44/26 |
| 2,336,154 | 12/1943 | Wolf | 201/9 |
| 2,729,598 | 1/1956 | Garbo | 201/9 X |
| 3,068,080 | 12/1962 | Ronzio | 44/17 |
| 4,111,755 | 9/1978 | Ban et al. | 44/1 F |
| 4,148,613 | 4/1979 | Myers | 44/6 X |

*Primary Examiner*—Carl F. Dees

*Attorney, Agent, or Firm*—Parmelee, Miller, Welsh & Kratz

[57] ABSTRACT

There is disclosed a method of reducing the swelling characteristics and bed characteristics of a pelletized fuel during a sintering operation. The method comprises the steps of pulverizing the coal to form a powdery mass, forming the mass into discrete pellets, providing a coating on the pellets with soluble salts, burnt lime, or hydrated lime, and heating the pellets to a temperature exceeding 800° F.

10 Claims, 1 Drawing Figure

METHOD FOR IMPROVING BED FIRING CHARACTERISTICS AND INHIBITING COALESCENCE OF COAL PELLETS

BACKGROUND OF THE INVENTION

Swelling varieties of coals mined from the midwestern area of the United States have a strong tendency to expand or bloat or exude tarry liquids when heated during carbonizing or pyrolyzing operations. This ordinarily takes place when heating coals to about the 600° F. to 1200° F. range while volatile matter becomes evolved and the coal matrix becomes softened. These midwest coals generally have a free-swelling index ranging from about 3 to 8 and have strong to mild coking or caking properties. The bloating characteristic tends to cause bedded and fired coals to become impervious during carbonizing or pyrolyzing reactions, and the ultimate charring of the tarry surface constituents causes agglomeration or porous beds into impervious masses or cakes, which inhibit draft-solid reactions. Such phenomena and reactions are carried out when coal is subjected to combustion, gasification, carbonization, or pyrolysis, using a heated gaseous media to react with the coal particles.

Prior art techniques for inhibiting coalescence of the coal bed involve some of the following approaches:

1. Coarse-sized coal particles are used with large interparticle voids to permit minor swelling to take place without complete obstruction or sealing of voids.
2. Inert recycle materials, such as previously fired coal (coke), are mixed with the coal as a partial of the bed.
3. Mechanical bed agitators or bed mixers are employed for imparting permeability while the bed is becoming fired.

Another method of inhibiting bed coalescence, to a certain extent, involves the use of a pelletizing operation. Coal is ground to about 65 mesh and is mixed with water and balled into discrete, close-sized green pellets. Intersticial voids of the pellet may occupy about 20 percent of the pellet volume; hence, these voids can allow for a small amount of bloating without pellet expansion during firing. Also, voids between individual pellets can allow a certain amount of bloating before the mass becomes impervious. This is similar to the use of coarse-sized coal for bed firing reactions.

The use of the pelletizing process for production of carbonized or pyrolyzed pellets is described in U.S. Pat. No. 4,111,755, the subject matter of which is incorporated herein by reference. Generally, that patent relates to a fixed sulfur fuel which is a highly upgraded material with many beneficial aspects with respect to its use as a source of energy from combustion or as a reagent for gasification. The fuel is pelletized coal, or pellet coke, and is produced by pyrolyzing balled mixtures of fine coal with limestone and/or alkaline oxides at high temperatures within a reducing or slightly oxidizing environment to cause simultaneous high temperature decomposition of the hydrocarbonaceous matter of the coal and calcination with sulfur fixation of the basic constituents.

More specifically, sulfur-bearing coal and limestone are proportioned in amounts which will cause the calcium in the limestone to react with a large amount of sulfur in the coal. The proportioned mixture is ground and blended, and then balled or compacted to form pellets. Those pellets are then subjected to either a carbonizing or pyrolyzing technique at a temperature of at least 800° F., and preferably between 1200° F. and 2200° F. These techniques are carried out on a traveling grate machine. If a pyrolyzing technique is employed, the firing operation is carried out in a reducing atmosphere, and preferably on a sealed, circular traveling grate machine of the type shown in U.S. Pat. No. 3,302,936. If a carbonization technique is employed, air is admitted to the firing zone and the firing operation need not be conducted in a sealed atmosphere. In either case, however, the presence of large amounts of carbon ensures a reducing condition in the traveling bed. During the firing operation, the limestone is calcined and the sulfur is fixed in a calcium compound which becomes stabilized in the ash after the pellet is burned as a fuel. The use of very high swelling coals in this process causes certain coalescence problems in firing the pellets by traveling grate operations, and these are not completely overcome by direct pelletizing operations.

When firing green pellets containing troublesome, high swelling and low softening coals, it is noted that:

1. The individual particles of the pellet bloat extensively to cause the pellet to expand and exude tarry liquid matter on the pellet surfaces.
2. Inter-pellet expansion and final adhesion from sticky surfaces occur between the soft expanding pellets which can practically fill the interpellet voids.
3. On some occasions, the swelling is followed by shrinking during firing, similar to tarry or foamy bubbles which collapse when they lose gas. This shrinking phenomenon causes large bed cracks within a partially coalesced bed because individual pellets of the coherent mass shrink and cause the bed to crack.
4. Large cracks within coalesced beds are avenues of short-circuiting of draft, and this causes inefficiencies of bed firing operations.

SUMMARY OF THE INVENTION

This invention provides a technique for overcoming bed coalescence and draft solid reaction inefficiencies from bed cracks.

It has been found that the problems of swelling and coalescing may be overcome by providing a coating material on the green pellets prior to the carbonization or pyrolyzing step. The coating material may be a soluble salt, burnt lime, or hydrated lime. It has been determined, in the case of soluble salts, that if such salts are incorporated within the green pellets, the salt migrates to the pellet surface during drying and concentrates on the pellet as crystals, which act as a parting media between adjacent pellets. Such phenomena occurred to a marked extent when sodium carbonate, for instance, was added to the pellet in a ratio of about 1 to 5% of the pellet weight. Also, it has been noted that calcium hydroxide exhibits this same tendency to a less marked extent.

It has also been determined that green coal pellets (plain or containing limestone as an additive) can be adequately rerolled in dry burnt lime or hydrated lime to absorb the surface water thereon and cause a firming or strengthening of the green pellet from absorption of the surplus water from the pellet voids. Lime added to the extent of about 4 to 10% of the green pellet weight markedly improves the green pellet quality by absorption of water, causes an approximate 0.1 to 1.0 mm. parting plane of lime to exist between adjacent bedded pellets to prevent moisture coalescence of the pellet mass, causes a high temperature, inert parting plane to exist between adjacent pellets to prevent exuded tarry matter from causing inter-pellet adhesion, and causes a fixation of highly reactive lime on the surface of the pellet to be reactive and markedly effective on absorption of sulfur evolving from the pellet core.

BRIEF DESCRIPTION OF THE DRAWING

The FIGURE illustrates a schematic representation in flow sheet form of the steps involved in the process according to this invention.

DETAILED DESCRIPTION OF THE INVENTION

Figure 1:
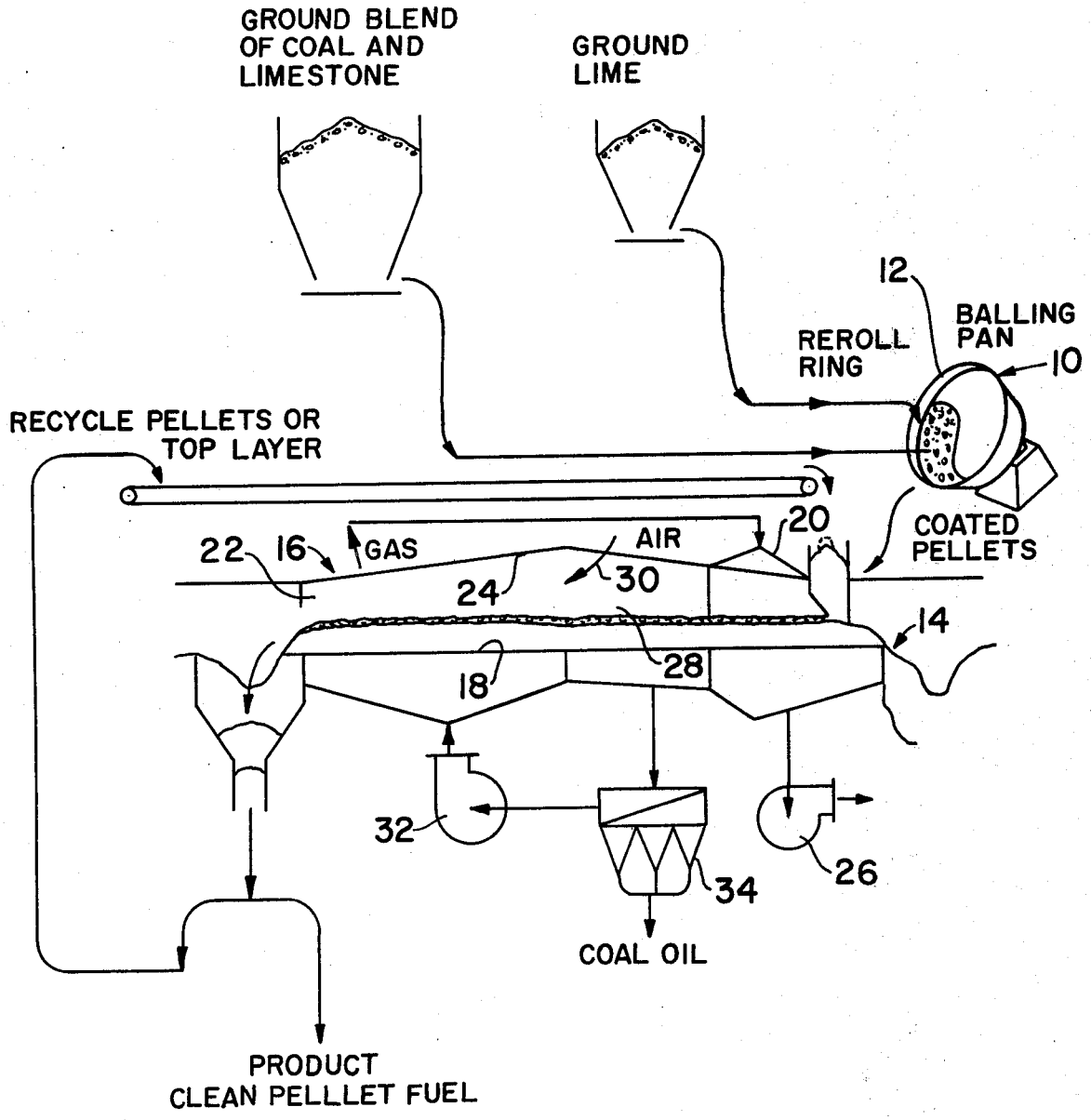

Referring now to the FIGURE, coal and limestone are proportioned in a ratio which is derived from about 1 to 5 parts of CaO per part of sulfur in the coal, i.e., coal containing 2.5% sulfur requires an addition of 2.5% to 12.5% of CaO or 5.0 to 25% limestone, which contains 50% CaO within the stone as $CaCO_3$.

Proportioning in a continuous system can be made by continuous weighing feeders which are adjusted to conform to a desired ratio.

After proportioning, the two raw materials are conveyed to a grinding and blending station, where they are ground and intimately blended to enable a final size structure which is suitable for balling or compacting and to provide an intimate mixture of very fine particles which enable sulfur fixation reactions to take place. Usually, a size structure of approximately −48 mesh is satisfactory for carrying out both phenomena. A number of approaches can be used for grinding and blending to provide a moist blend for balling. For example, one such technique is wet circuit grinding, wherein both coal and limestone in their natural states are wet-ground and blended together in a ball mill with water, and a slurry is filtered to a filter cake by vacuum filtration.

Another technique involves dry circuit grinding, wherein the coal and limestone are ground together or separately and co-mixed during the grinding in a dry ball milling circuit.

Still another technique involves wet and dry grinding, wherein one of the raw materials, such as coal, can be wet-ground and filtered and blended with dry-ground limestone within a miller or pug mill arrangement. If the coating material is intended to be a soluble salt, the salt may be added at this stage.

After grinding, the mixed coal and limestone is filtered at a filtering station and the material is conveyed to a balling or compacting machine 10. Optionally, a balling additive such as bentonite or lime can be added on the conveyor to assist balling operations. The moistened blend of ground coal and limestone is balled in a rotary pan or drum, such as the rotary pan or drum shown in U.S. Pat. No. 3,060,496. Small quantities of additional water are added to produce discrete balls approximately one-half inch in diameter. After the balls are formed, they tend to roll from the balling pan and over a reroll ring 12. The reroll ring is continuously coated with ground lime so that the green, moist balls pick up the lime as they are discharged from the balling pan. The coated pellets are then conveyed to a charging station 14 of a traveling grate sintering machine 16. The traveling grate machine 16 adapted to carry out a pyrolyzing operation is shown in detail in U.S. Pat. No. 3,302,936, the subject matter of which is incorporated herein by reference. The pellets are conveyed along a grate 18 through a drying zone 20. In the drying zone, the pellets are subjected to a downdraft of gases of pyrolysis taken from a cooling zone 22 to a suitable conduit 24 and sent through the traveling bed of pellets by a blower 26.

From the drying zone 20, the pellets are conveyed to a firing zone 28, where the pellets are subjected to a downdraft at a temperature exceeding 800° F., and preferably within the range of 1200° to 2200° F. Air is employed as a fuel and is admitted to the firing zone generally, as indicated by the arrow 30. The downdraft is caused by suction produced by a blower 32, and reaction gases from the firing zone are recovered and condensed in a liquid hydrocarbon recovery system 34. In the firing zone, a number of reactions take place. It should be appreciated that calcium carbonate is the predominant compound of limestone, and under the high temperature conditions of pyrolysis and combustion, it converts partially to reactive CaO and $CO_2$. Hot CaO has a high affinity for sulfur in the reduced or oxidized state. Some reactions which occur from pyrolysis of coal-limestone pellets which tend to fix the sulfur, are:

$$FeS + CaO + C \rightarrow Fe + CO + CaS$$

$$H_2S + CaO \rightarrow H_2O + CaS$$

$$COS + CaO \rightarrow CO_2 + CaS.$$

Under oxidizing conditions, CaS as fixed sulfur can form stable $CaSO_4$ as follows:

$$CaS + 202 \rightarrow CaSO_4.$$

This can also retain sulfur in the fixed state.

Bed cracks which occur during traveling grate firing operations provide paths of violent, unrestricted draft flow, which in turn inhibit uniform draft flow through the more impervious zones of the pellet bed. Such phenomena cause excessive flow and bed temperatures through cracks, and minimum flow of minimum temperature and minimum reactions in other portions of the bed. This gives rise to inefficiencies which can be overcome through the use of a free-flowing top layer of charge. Therefore, a portion of the spent pellets is recycled back to the charging zone and is layered onto the bed of green pellets.

Recycled fired pellets are relatively inert with respect to swelling and sticking problems because these characteristics were destroyed by pyrolysis or firing reactions. When free-flowing recycle pellets are applied as a top layer on a green pellet charge on the traveling grate, they serve several important functions. Recycled pellets act as a thermal buffer within the drying zone and can inhibit hot recycle draft from spalling the green pellets. When the pellet bed of fired green pellets becomes cracked from the foregoing-described phenomena, the pellets on the top layer of free-flowing green pellets act as plugs and enable the uniform draft flow to exist within the bed. This inhibits short-circuiting of draft and causes much improvement of the bed reaction efficiencies.

The total time that the pellets are subjected to the firing operation is preferably maintained at a time period of less than one hour to ensure that the pellets will be free of any significant amounts of graphite. The presence of graphite greatly reduces the efficiency of the pellets when they are combusted as a fuel. The results of pellet firing tests using reagents and reroll operations for inhibiting bed coalescence and showing the effect of pellet surface layers are illustrated in Table 1 as follows:

TABLE I

| | Blend Composition of Green Pellets | Size analyses of fired product** (% + 1" structures) |
|---|---|---|
| T-84 | Broken Aro filter cake* No reagents | 28.86 |
| T-86 | Broken Aro filter cake No reagents | 29.82 |
| T-87 | Broken Aro filter cake Internal 7.6% lime hydrate | 1.74 |
| T-88 | Broken Aro filter cake Internal 7.6% lime hydrate | 0.88 |
| T-97 | Broken Aro filter cake Internal 3.8% lime hydrate | 0.00 |
| T-98 | Broken Aro filter cake Internal 3.99% soda ash | 0.00 |
| T-182 | Broken Aro coal filter cake Reroll - 9.4% burnt lime | 0.60 |

*Filter cake is comprised of 80% Broken Aro coal and 20% limestone.
**The size analyses are used to depict the extent of bed coalescence or bed agglomeration. High numbers indicate extensive coalescence.

It may be noted that even though the Broken Aro filter cake contains 20% limestone, in all the examples given, considerable swelling occurs where no coating substances are added to the pellets. However, by adding the coating substance, swelling is essentially eliminated.

Although the preferred embodiment of this invention has been shown and described, it should be understood that various modifications and rearrangements of parts may be resorted to without departing from the scope of the invention as disclosed and claimed herein.

What is claimed is:

1. A method of reducing the swelling characteristics and bed coalescence characteristics of a pelletized fuel during a sintering operation comprising the steps of pulverizing the coal to form a powdery mass, forming said mass into discrete pellets, providing on the surface of said pellets a coating substance selected from the group consisting of sodium carbonate, burnt lime, and hydrated lime, drying said pellets and heating said pellets to a temperature exceeding 800° F.

2. A method according to claim 1, wherein powdered limestone is mixed with said powdery mass.

3. A method according to claim 2, wherein said powdered limestone is present in amounts of about 20%.

4. A method according to claim 1, wherein the coating substance is initially mixed with the powdery mass and migrates to the surface of the pellets during the drying step.

5. A method according to claim 4, wherein said coating substance is sodium carbonate.

6. A method according to claim 5, wherein said sodium carbonate is present in amounts of between 1 and 5 percent by weight.

7. A method according to claim 1, wherein said coated material is deposited directly on the surface of the pellet prior to drying the pellet.

8. A method according to claim 7, wherein said coating material is lime.

9. A method according to claim 8, wherein said lime is present in amounts of between 4 and 10 percent by weight.

10. A method according to claim 1, wherein recycled fired pellets are layered onto the discrete green pellets prior to heating the pellets.

* * * * *